US008256591B2

(12) United States Patent
Majeau

(10) Patent No.: US 8,256,591 B2
(45) Date of Patent: Sep. 4, 2012

(54) U-BEAM SUPPORT MECHANISM FOR LUGGAGE

(75) Inventor: Bernard H. Majeau, Highlands Ranch, CO (US)

(73) Assignee: eBags, Inc., Greenwood Village, CO (US)

( * ) Notice: Subject to any disclaimer, the term of this patent is extended or adjusted under 35 U.S.C. 154(b) by 227 days.

(21) Appl. No.: 12/719,734

(22) Filed: Mar. 8, 2010

(65) Prior Publication Data

US 2010/0224457 A1 Sep. 9, 2010

Related U.S. Application Data

(60) Provisional application No. 61/158,093, filed on Mar. 6, 2009.

(51) Int. Cl.
*A45C 5/14* (2006.01)
*A45C 13/26* (2006.01)
*A45C 13/36* (2006.01)

(52) U.S. Cl. ..... 190/18 A; 190/24; 190/39; 190/115; 190/127; 16/113.1; 16/405

(58) Field of Classification Search ..... 190/24, 190/39, 115, 122, 18 A, 127; 16/113.1, 405
See application file for complete search history.

(56) References Cited

U.S. PATENT DOCUMENTS 3,084,771 A 4/1963 Davis
3,559,778 A 2/1971 D'Elia et al.
3,962,010 A 6/1976 Riou et al.
4,374,555 A 2/1983 March
4,538,709 A * 9/1985 Williams et al. ..... 190/18 A
4,550,813 A * 11/1985 Browning ..... 190/18 A
4,762,211 A * 8/1988 Krenzel ..... 190/122
5,115,895 A * 5/1992 Myers ..... 190/18 A
5,368,143 A 11/1994 Pond et al.
5,431,262 A * 7/1995 Rekuc et al. ..... 190/18 A
5,476,163 A 12/1995 Wu
5,482,147 A 1/1996 Wang
5,526,908 A 6/1996 Wang
5,566,797 A 10/1996 Van Himbeeck
5,575,362 A 11/1996 Franklin et al.
5,588,512 A 12/1996 Lin
5,590,748 A 1/1997 Chang
5,590,891 A 1/1997 Kazmark, Jr.
5,653,319 A 8/1997 Wang
5,685,403 A 11/1997 Morszeck
5,709,398 A 1/1998 Lu
5,782,325 A 7/1998 O'Shea et al.
5,794,744 A 8/1998 Lin
5,950,779 A * 9/1999 Miyoshi ..... 190/18 A
6,024,194 A 2/2000 Chung-Hsien
6,062,357 A * 5/2000 Bogert ..... 190/18 A
6,186,295 B1 2/2001 Lin et al.
6,220,412 B1 4/2001 Lin
6,260,680 B1 7/2001 Lin
6,298,964 B1 * 10/2001 Sadow ..... 190/18 A
6,301,746 B1 * 10/2001 Myers et al. ..... 16/113.1
6,575,493 B1 * 6/2003 Lowenstein ..... 280/655.1
6,612,413 B2 9/2003 Kuwayama
6,651,792 B1 11/2003 Kuwayama
6,892,434 B2 5/2005 Fenton et al.
7,086,511 B2 8/2006 Morszeck et al.
2002/0096410 A1 * 7/2002 Nykoluk ..... 190/115
2005/0051405 A1 3/2005 Liang
2005/0056511 A1 3/2005 Hsieh
2005/0173896 A1 * 8/2005 Kim et al. ..... 280/655
2009/0026031 A1 * 1/2009 Wilczak et al. ..... 190/115

* cited by examiner

*Primary Examiner* — Sue Weaver
(74) *Attorney, Agent, or Firm* — Sheridan Ross P.C.

(57) ABSTRACT

The present invention relates generally to a support mechanism for luggage, and more specifically to a support mechanism for luggage having U-shaped recesses within which telescoping handle tubes are positioned.

21 Claims, 7 Drawing Sheets

U-BEAM SUPPORT MECHANISM FOR LUGGAGE

CROSS REFERENCE

The present application claims the benefit of U.S. Provisional Application No. 61/158,093, entitled "U-Bean Support Mechanism for Luggage" filed on Mar. 6, 2009, the entire contents of which is incorporated herein in its entirety by this reference.

FIELD OF THE INVENTION

The present invention relates generally to a support mechanism for luggage, and more specifically to a support mechanism for luggage having U-shaped recesses within which one or more handles are positioned.

BACKGROUND OF THE INVENTION

Luggage is well known in the art and is used by travelers for transporting personal belongings between one location and another. Travelers typically prefer luggage having wheels and a pull-handle. Wheeled luggage is more easily pulled than carried over most terrain. Commonly when the luggage is wheeled, the pull-handle extends from the luggage framework to facilitate pulling the luggage and retracts into the luggage when the luggage is stowed or transported as cargo.

Telescoping luggage handles favored by travelers can become jammed due to over-packing of the luggage or external pressure on the luggage. For example, pressure on the telescoping luggage handles can be great enough to cause deflection within the luggage handles. The deflection caused by over-packing can be enough that the luggage handles cannot be extended (or in the alternative, stowed) or require a greater force than typically required to extend (or in the alternative, stow) the handles.

SUMMARY OF THE INVENTION

There is a need in the luggage industry for durable, lightweight luggage which protects personal belongings contained within the luggage. An object of the present invention is a luggage system having impact protection and structural support, as well as being durable and light-weight.

One aspect of the present invention is a reinforcement mechanism adapted for positioning within a piece of luggage having a retractable handle. The reinforcement mechanism comprises a generally rectangularly shaped support member having an upper end, a lower end, opposing lateral edges extending therebetween, and a front surface and a back surface. Preferably, the luggage reinforcement mechanism is comprised of at least one of a metal, a metal alloy, a polymer, a composite, a polymeric blend, a polymeric laminate, a fiberglass material, and a carbon fiber material, and a combination thereof.

One or more grooved passages are positioned on the front surface of the support member. The one or more grooved passages are adapted to receive at least a portion of a retractable handle assembly. In one embodiment, a pair of substantially parallel grooved passages is positioned on the front surface of the support member. Preferably, the grooved passages generally have one of a "U" or "C" cross-sectional shape. In another embodiment, the grooved passages extend substantially from the upper end and the lower end of the support member.

In a preferred embodiment, the reinforcement mechanism is interconnected to a lower bracket assembly. Even more preferred, the lower bracket assembly is positioned over a lower portion of at least a portion of the retractable handle assembly to provide structural support.

In one embodiment, one or more reinforcing ribs are positioned on the front surface of the support member. Preferably, the one or more reinforcing ribs are positioned between the pair of grooved passages. More preferably, the reinforcing ribs are aligned in a substantially parallel configuration. The reinforcing ribs can have a width and a depth, preferably the reinforcing rib width is from about 0.4 inches to about 1.0 inches and the rib depth is from about 0.5 inches to about 1.5 inches.

In a preferred embodiment, three reinforcing ribs are positioned on the front surface of the support member. Furthermore, the three reinforcing ribs are positioned in a substantially parallel configuration between the grooved passages.

In another embodiment, the reinforcement mechanism further comprises an attachment means for operably interconnecting the generally rectangularly shaped support member to an internal framework of the piece of luggage. Preferably, the attachment means comprises one or more of a screw, a blot, a pin and a rivet.

Another aspect of the present invention is a wheeled luggage system with a retractable handle and a storage compartment. The storage compartment has a back wall, a front wall, a pair of sidewalls, a top wall and a bottom wall. A wheel assembly is operably interconnected to the luggage bottom wall. The upper end of the support member is positioned adjacent to the top wall of the storage compartment and the lower end of the support member is positioned adjacent to the bottom wall of the storage container.

Another aspect of the present invention is a wheeled luggage system with a retractable handle and a storage compartment. The storage compartment has a back wall, a front wall, a pair of sidewalls, a top wall and a bottom wall. A wheel assembly is operably interconnected to the luggage bottom wall. The upper end of the support member is positioned adjacent to the top wall of the storage compartment and the lower end of the support member is positioned adjacent to the bottom wall of the storage container.

The luggage support member comprises a substantially rigid plate having an upper end, a lower end and two lateral edges extending therebetween. Furthermore, the luggage support member has at least one grooved passageway. The grooved passageway extends substantially between the upper end and the lower end of the substantially rigid plate. The grooved passageway is adapted to receive a portion of the retractable handle. The luggage support member is comprised of one or more of a metal, a metal alloy, a polymer, a composite, a fiberglass material, a carbon fiber material, a polymeric blend, a polymeric laminate, and a combination thereof. Preferably, the luggage support member is integrally formed into said back wall of the storage compartment.

The substantially rigid plate preferably has one or more reinforcing ribs. In one preferred embodiment, the one or more reinforcing ribs are positioned between a pair of grooved passages. Each of the one or more reinforcing ribs comprises a longitudinally extending channel having an arcuate cross-sectional shape. Preferably, the substantially rigid plate has a serpentine shaped cross-sectional shape. In one embodiment, the substantially rigid plate has at least one attachment mechanism positioned in the support member. The at least one attachment mechanism is adapted to attach the support member to the back wall of the storage compartment. In another embodiment, the luggage support member has opposing upper and lower mounting elements to interconnect the rigid plate to the back panel of the luggage piece.

In one embodiment, the substantially rigid plate has at least one attachment mechanism positioned in the support member. The at least one attachment mechanism is adapted to attach the support member to the back wall of the storage compartment. In another embodiment, the luggage support member has opposing upper and lower mounting elements to interconnect the rigid plate to the back panel of the luggage piece.

In another embodiment, the retractable handle has a handle grip and at least one handle tube. In a preferred embodiment, the at least one handle tube reciprocates within an exterior tube. Preferably, the at least one handle tube can be selectively extended. In another preferred embodiment, the at least one handle tube is positioned at least partially within one of the grooved passages. Over a lower portion of at least one handle tube a lower bracket assembly is preferably positioned. The lower bracket assembly receives the lower portion of the retractable handle. The lower bracket assembly is positioned over the lower portion of the handle tube to provide structural support to the luggage system. Preferably, the luggage support member is positioned between the at least one handle tube and the back wall. The positioning of the luggage support member between the at least handle tube and back wall substantially provides impact protection to the at least one handle tube. In yet another embodiment, the retractable handle has a biased stop pin. The biased pin restrains the retractable handle from being extended when the biased pin is positioned within the lower bracket assembly. Preferably, the biased pin is located in the lower portion of the retractable handle.

The wheeled luggage system further has an upper housing assembly. The upper housing assembly has at least one passageway aligned with at least one grooved passage. The upper housing assembly passageway receives the at least one handle tube. The upper housing assembly is interconnected to the upper end of the support member. Furthermore, the lower bracket assembly is interconnected to the lower end of the support member. In one embodiment, the support member may comprise a substantially rigid plate. Preferably, the upper housing assembly nests with an upper end of the substantially rigid plate. More preferably, the upper end of the rigid plate fits within an interior portion of the upper housing. The upper housing slides over the at least one handle tube. The upper housing can be moved up and down the handle tube for interconnecting the upper housing with the support member.

Another aspect of the present invention is a retractable handle assembly adapted for use with a piece of luggage. The retractable handle assembly comprises a handle interconnected to a pair of handle tubes and a substantially rigid plate. The rigid plate has an upper end, a lower end and lateral edges extending therebetween, and a pair of grooved passages substantially aligned substantially parallel with the lateral edges at least one structural rib positioned parallel to the pair of grooved passages. In a preferred embodiment, the at least one structural rib is positioned proximate to the pair of grooved passages. Preferably, the grooved passages extend substantially between the upper end and the lower end of the rigid plate. The pair of grooved passages is adapted to receive the handle tubes. In a preferred embodiment the rigid plate has opposing upper and lower mounting elements to interconnect the plate to a back panel of the luggage piece.

The handle assembly further comprises an upper housing assembly and a lower bracket assembly. The upper housing assembly retains an upper portion of the handle tubes in a secure position. Furthermore, the upper housing assembly is interconnected to the upper end of the substantially rigid plate. The lower bracket assembly overlaps a lower portion of the handle tubes. Preferably, the lower bracket assembly is interconnected to the lower portion of the substantially rigid plate.

In a preferred embodiment, a lower end of at least one handle tube has a biased stop pin. The biased stop pin restrains the retractable handle from being extended beyond a predetermined position.

The handle assembly further comprises a pair of outer handle tube housings. The handle tubes reciprocate within a respective handle tube housing. Furthermore, the upper housing slidingly engages the outer tube handles to allow for minor adjustments during assembly. In a preferred embodiment, each of the outer tube handle tube housings fits into one of the pair of grooved passageways.

The support mechanism can be a load-bearing surface for the storage container. The support mechanism can substantially bear one or both of external and internal pressures applied to the storage container. The external and/or internal pressures supported by the support mechanism substantially insulate the pull handles from one or both of the external and internal pressures. Furthermore, the support mechanism can provide rigidity to the storage container, specifically about the back wall of the storage container. In one embodiment, the support mechanism provides rigidity to the back wall, while maintaining some degree of flexibility of the back wall. The support mechanism allows for a soft, flexible storage container with a substantially rigid back wall. Furthermore, the support mechanism can decrease the amount materials required to reinforce a suitcase, allow for faster and/or more easily assembly of a suitcase, and/or decrease manufacturing economics for manufacturing a suitcase.

These and other advantages will be apparent from the disclosure of the invention contained herein. As used herein, "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B or C" and "A, B, and/or C" means A alone, B alone, C alone, A and B together, A and C together, B and C together, or A, B and C together.

It is to be noted that the term "a" or "an" entity refers to one or more of that entity. As such, the terms "a" (or "an"), "one or more" and "at least one" can be used interchangeably herein. It is also to be noted that the terms "comprising", "including", and "having" can be used interchangeably.

The above-described embodiments and configurations are neither complete nor exhaustive. As will be appreciated, other embodiments of the invention are possible utilizing, alone or in combination, one or more of the features set forth above or described in detail below.

DETAILED DESCRIPTION

Figure 1:
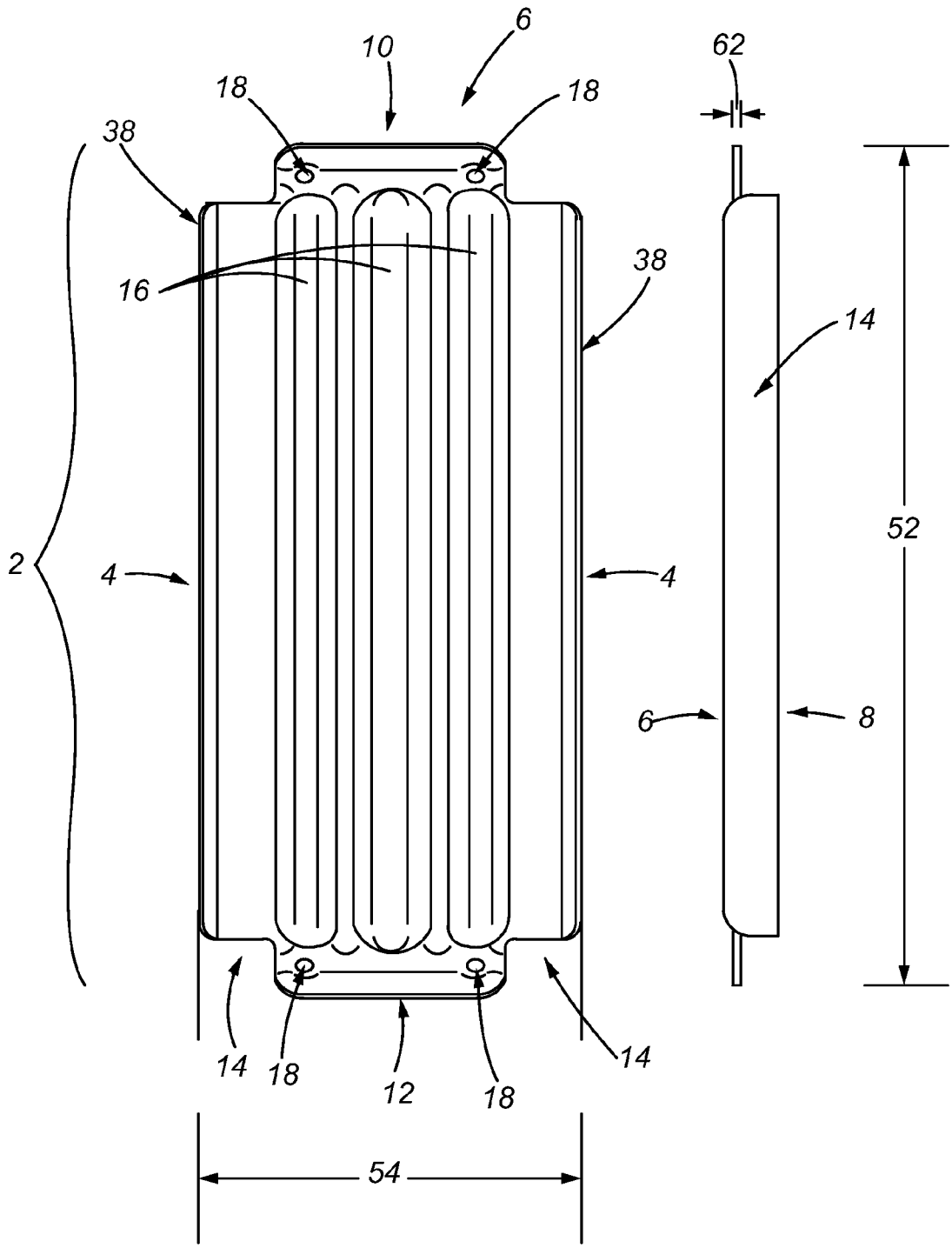
FIG. 1 depict top and side views of a support mechanism according to one aspect of the present invention.
Figure 2:
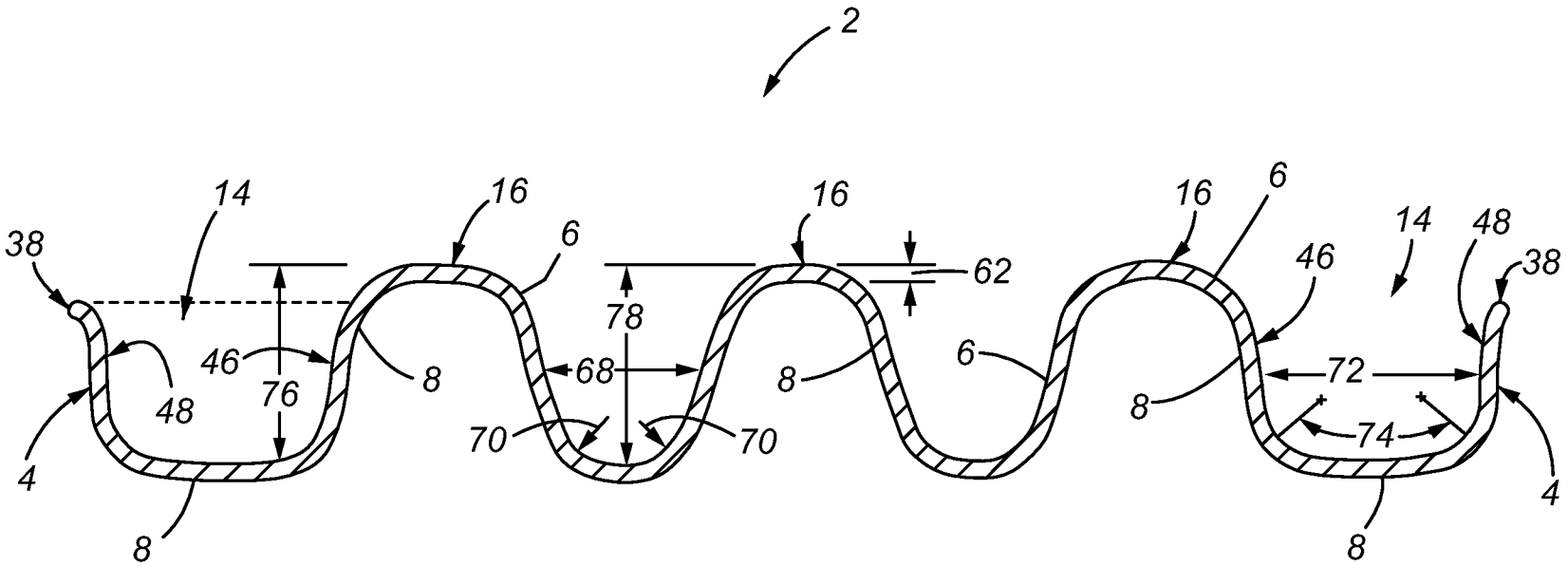
FIG. 2 depicts a cross-sectional view of FIG. 1.

Referring now to the drawings, FIGS. 1-6 depict various aspects of the present invention. The support mechanism 2 generally has a rectangular shape, two opposing sides 4, opposing front 6 and back 8 support mechanism surfaces, and opposing upper 10 and lower 12 ends. In a preferred embodiment, one or more substantially parallel grooved passages 14 are positioned on the support mechanism front surface 6 and typically extend from the upper end 10 to the lower end 12. Each of the one or more grooved passages 14 has opposing inner 46 and outer 48 legs.

Preferably, the support mechanism 2 comprises a pair of grooved passages 14 positioned on the support mechanism front surface 6 substantially about equidistance from the two opposing sides 4 and typically extending from the upper end 10 to the lower end 12. In another embodiment, the support mechanism 2 comprises a single grooved passage 14.

Typically, the grooved passage 14 has a cross-sectional shape commonly resembling the letter "U", "C" or another alternative geometry defining a passageway for receiving a telescoping pull handle. Preferably, each grooved passage 14 is substantially parallel to the support mechanism sides 4. Each outer leg 48 typically forms one of the two opposing support mechanism sides 4. Each support mechanism side 4 typically has a lateral edge 38. Non-limiting examples of the lateral edge 38 are a substantially flat edge, a beaded edge, a rounded edge, and an edge formed by bending a portion of the outer leg 48 over onto itself to form a generally J-shaped edge.

The grooved passage 14 has a grooved-passage width 72, a grooved-passage depth 76 and grooved-passage radius of curvature 74. The grooved-passage width 72 can range from about 0.2 inch to about 3 inches, preferably from about 0.5 inch to about 2 inches. More preferably, the grooved-passage width 72 is from about 0.75 inch about 1.25 inches. The grooved-passage depth 76 can be from about 0.2 inch to about 2 inches, preferably from about 0.5 inch to about 1.5 inches. More preferably, the grooved-passage depth 76 is from about 0.5 inch to about 1.0 inch. The grooved-passage radius of curvature 74 can range from about 0.0 inch to about 2 inches. Preferably, the grooved-passage radius of curvature 74 is from about 0.6 inch to about 0.8 inch.

Preferably, one or more of reinforcing ribs 16 are positioned adjacent to the one or more grooved passages 14. The reinforcing ribs 16 may be orientated substantially parallel or substantially perpendicular to the one or more grooved passages 14. In a preferred embodiment, the reinforcing ribs 16 are orientated substantially parallel to the one or more grooved passages 14. The reinforcing ribs 16 can be positioned on one or both of the support mechanism front 6 and/or back 8 surfaces. Preferably, the reinforcing ribs 16 are positioned on the front surface 6 of the support mechanism 2.

In one embodiment, the support mechanism 2 has one or more support attachment means 18. The support attachment means 18 generally comprise an aperture, tongue and groove joint, dove-tail joint, lap joint, butt-joint, single V-joint, T-joint, or combination thereof. In one preferred embodiment, the support attachment means 18 comprise an aperture for the interconnecting the support mechanism to a container with a device comprising one of a bolt, a dowel, a rivet, a screw, a latch, a hook, a pin, a stitch, or a combination thereof.

In another embodiment, the support attachment means 18 can comprises a joint. In such an instance the interconnection can be by coupling, pressure fitting and/or joining, hooking (wherein at least one element forming the hooking comprises a void, such as, but not limited to a groove and/or aperture), latching, interlocking, welding, adhesive joining (such as, but not limited to thermosetting and/or thermoplastic adhesives), or combinations thereof. Herein joining by welding can mean without limitation fusing by hammering, compressing, alloying, melting, coalescing, or soldering. Additionally, joining by welding can be by flame, electric, arc, laser, electron beam, friction, ultrasound, or resistance welding. As used herein joining by interlocking can mean without limitation to fit together by interlacing to prevent movement in one or more directions. The interlocking can be utilized alone or in combination with other attachment methods to further facilitate the joining and/or interconnecting.

The support mechanism 2 comprises a resilient material substantially having resistance to damage from one or more of compression, abrasion, and/or impact. That is, the support mechanism material is generally rigid enough to resist deformation and/or damage typically encountered by luggage, while generally flexible enough to resist one or more of cracking, shattering, chipping, fracturing, denting, puncturing, deforming, distorting, or changing shape upon impact and/or compression.

Preferably, the support mechanism 2 has a hardness of about 90 to about 121 on the Rockwell R hardness scale. In one embodiment, the support mechanism 2 has an ultimate tensile strength from about 25 to about 7 MPa. In another embodiment, the support mechanism 2 has a flexural modulus from about 1 to about 7 GPa. In yet another embodiment, the support mechanism 2 has impact values ranging from about 0.5 to about 2.5 J/cm (Izod impact, unnotched low temperature) to about 0.3 to about 7 J/cm (Izod impact, notched).

The support mechanism 2 typically comprises one or more of a metal, metal alloy, polymeric material, polymeric alloy, composite material, fiberglass composite, carbon fiber composite, polymeric laminate, and a combination thereof. Preferably, the support mechanism comprises one of a metal or polymeric material. The metal or polymeric material may further comprise an alloy and/or composite material. Preferred metals comprise one or more of iron, aluminum, titanium, and magnesium. Preferred polymeric materials comprise homopolymers and copolymers of polyacetals, polyacrylics, polyamides, polyanhydrides, polycarbonates, polydienes, polyesters, polyhalo-olefins, polyimides, polyketones, polyolefins, polyoxides, polyphosphazenes, polyphylenes, polysilanes, polysiloxanes, polystyrenes, polysulfides, polysulfoamides, polysulfonates, polysulfones, polysulfoxides, polythianhydrides, polythioamides, polythiocarbonates, polythioesters, polythioimides, polythioketones, polythioureas, polythiourethanes, polyureas, polyurethanes, polyvinyls, and combinations thereof. In a more preferred embodiment the polymeric material comprises homopolymers and copolymers of polyamies, polycarbonates, polyesters, polyolefins, polyurethanes, polyvinyls, and combinations thereof.

The polymeric material may comprise one of polyolefin selected from the group of polyolefins consisting of a cross-linked polyethylene (PEX), high-density polyethylene (HDPE), linear low-density polyethylene (LLDPE), low-density polyethylene (LDPE), polyethylene, polypropylene, ultra high molecular weight polyethylene (UHMWPE), high molecular weight polyethylene (HMWPE), high density cross-linked polyethylene (HDXLPE), medium density polyethylene (MDPE), very low density polyethylene (VLDPE), and mixtures thereof. The polyolefin material can comprise a random and/or block copolymer.

In another embodiment, polymeric material can comprise a thermoplastic elastomer. While not wanting to be bound by any theory, the thermoplastic elastomer comprises a copolymer and/or physical mixture of polymers comprising one or more of styrenic block copolymers, polyolefin blends, elastomeric alloys (such as, thermoplastic vulcanizates), thermoplastic polyurethanes, thermoplastic copolyesters, thermoplastic polyamides, and combinations thereof.

In preferred embodiment, the support mechanism 2 comprises a thermoplastic acrylonitrile butadiene styrene. The acrylonitrile butadiene styrene may comprise from about 10 to about 40 wt % acrylonitrile, from about 5 to about 40 wt % butadiene and from about 30 to about 70 styrene.

The rigidity of the support mechanism material is generally determined at least by one or both of the support mechanism material (that is, the physical properties of the material, such as but not limited to the elastic modulus, modulus of rupture, hardness, bending stiffness, etc.) and/or physical properties of the support mechanism. One support mechanism physical property that can influence the rigidity of the support mechanism 2 is support mechanism thickness 62. Generally for a given support mechanism material, the support member 2 having the greater thickness has the greater rigidity. The support mechanism thickness 62 typically varies according to the support mechanism material, less rigid support mechanism materials generally requiring a greater thickness than more rigid support mechanism materials. Typically, the support mechanism thickness 62 is from about 0.02 inch to about 1 inch. Preferably, the support mechanism thickness 62 is from about 0.05 inch to about 0.2 inch. More preferably, the support mechanism thickness 62 is from about 0.07 inch to about 0.15 inch.

The addition of the reinforcing ribs 16 is another support mechanism physical property that can influence rigidity. The reinforcing ribs 16 typically number from about 0 to about 50. Preferably, the number of reinforcing ribs 16 is from about 2 to about 15. More preferably, the support mechanism 2 comprises from about 3 to about 5 reinforcing ribs. Even more preferably, the number of reinforcing ribs 16 is about one of 2 or 3.

The reinforcing ribs 16 generally comprise a channel. The rib channel may generally resemble a U-, C-, or arcuate cross-sectional shape. Each reinforcing rib channel has a rib width 68, a rib depth 78 and a rib radius of curvature 70. The reinforcing rib width 68, depth 78 and curvature 70 can influence the rigidity of the reinforcing rib 16 and/or degree of rigidity of the support mechanism 2. Preferably, the reinforcing rib width 68 is from about 0.2 inch to about 2.0 inch, more preferably from about 0.4 inch to about 1.0 inch. Even more preferably, the reinforcing rib width 68 is from about 0.6 inch to about 0.8 inch. Preferably, the reinforcing rib depth 78 is from about 0.2 inch to about 3.0 inch, more preferably from about 0.5 inch to about 1.5 inch. Even more preferably, the reinforcing rib depth 78 is from about 0.7 inch to about 1.0 inch. Preferably, the reinforcing rib radius of curvature 70 is from about 0.0 to about 2.0 inch, more preferably from about 0.1 inch to about 1.0 inch. Even more preferably, the radius of curvature 70 is form about 0.2 inch to about 0.6 inch.

Figure 3A:
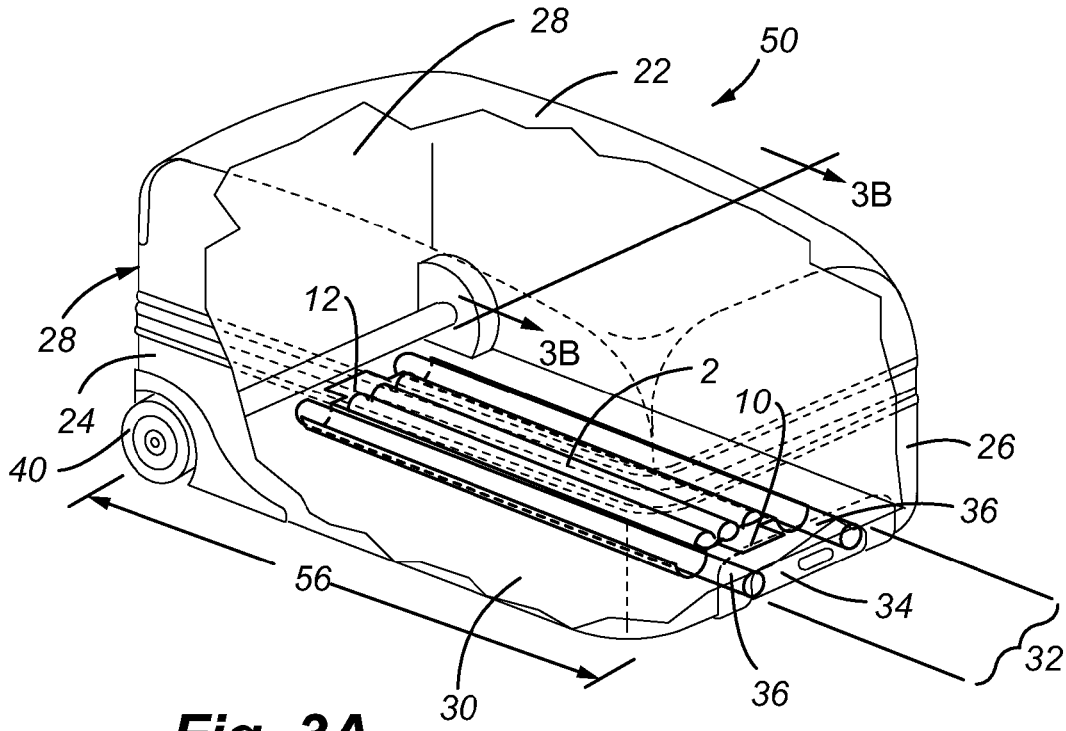
FIGS. 3A-3C depict cut-away and cross-sectional views of a storage container having a support mechanism according to another aspect of the present invention.
Figure 3B:
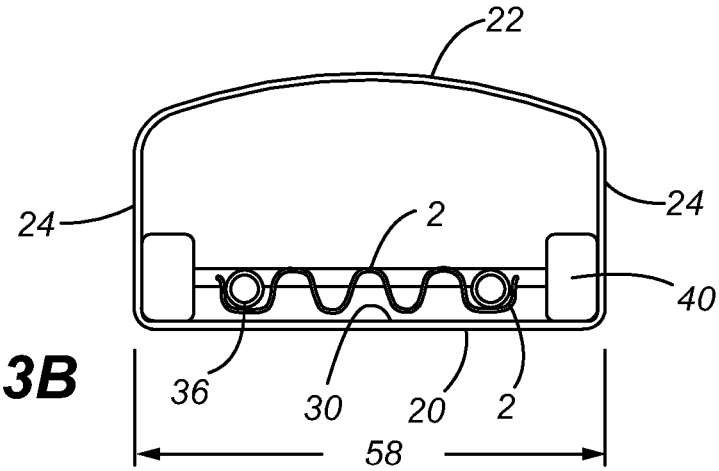
Figure 3C:
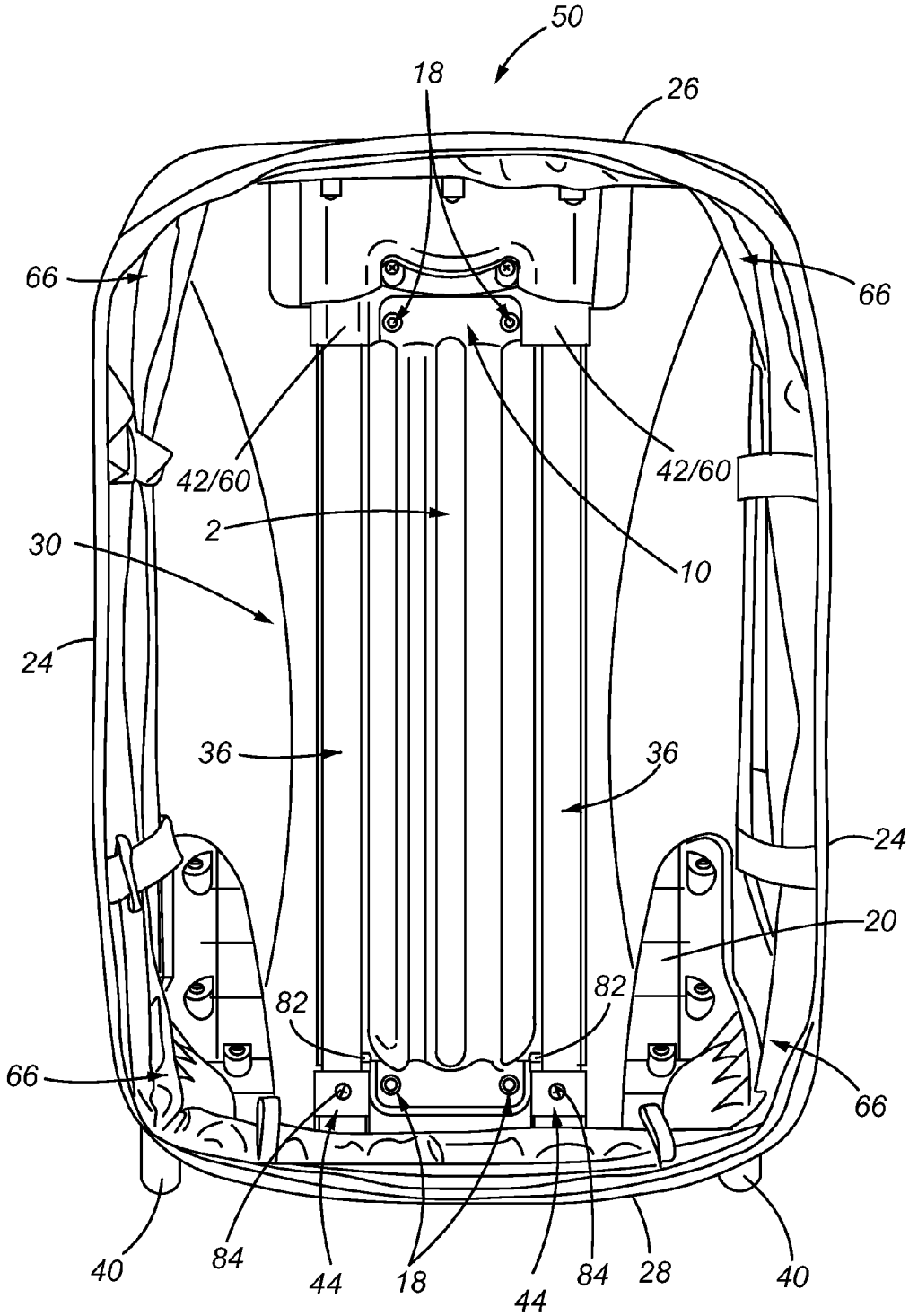

FIGS. 3A-3C depict another aspect of the present invention comprising the support mechanism 2 positioned within a typical storage container 50 having a retractable handle system 32. The storage container 50 generally comprises opposing front 22 and back 20 walls, opposing top 26 and bottom 28 walls, a container liner 66, a pair of opposing side walls 24, a container width 58, and a container length 56. In a preferred embodiment, the storage container 50 is a suitcase. The handle system 32 may have one or more handle tubes 36. Typically, the handle system 32 comprises a pair of handle tubes 36 connected to a handle grip 34.

FIGS. 3A-3C depict the support mechanism 2 positioned adjacent to the back wall 20 between the handle tubes 36 and the internal back wall 30 (FIG. 3B) with the support mechanism upper end 10 positioned adjacent to the top wall 26 and the support mechanism lower end 12 positioned adjacent to the internal bottom wall 28 (FIG. 3A, depicted without upper housing assembly 42 and lower bracket assembly 44). The support mechanism 2 and handle tubes 36 are positioned between the container liner 66 and internal back wall 30 (FIG. 3C, with liner 66 peeled back for clarity). Preferably, the support mechanism width 54 is at least about 40% of the storage container width 58 but could be any width that provides sufficient strength. More preferably, the support mechanism length 52 is at least about 70% of the storage container length 56 but could be any length that provides sufficient rigidity and strength. In a preferred embodiment, the support mechanism length 52 is about 80% to about 98% of the storage container length 56.

The grooved passageways 14 are preferably adapted to receive the handle tubes 36 with the handle tubes 36 positioned between the support mechanism 2 and receiving elements 60 of upper housing 42 and lower bracket assembly 44. The receiving elements 60 are preferably adapted to receive the handle tubes 36. The receiving elements 60 are generally C- or U-shaped elements for operationally interconnecting the handle tubes 36 to the upper housing 42 and lower bracket assembly 44 but functional geometrics other than C- or U-shaped elements may be used as well.

Figure 5:
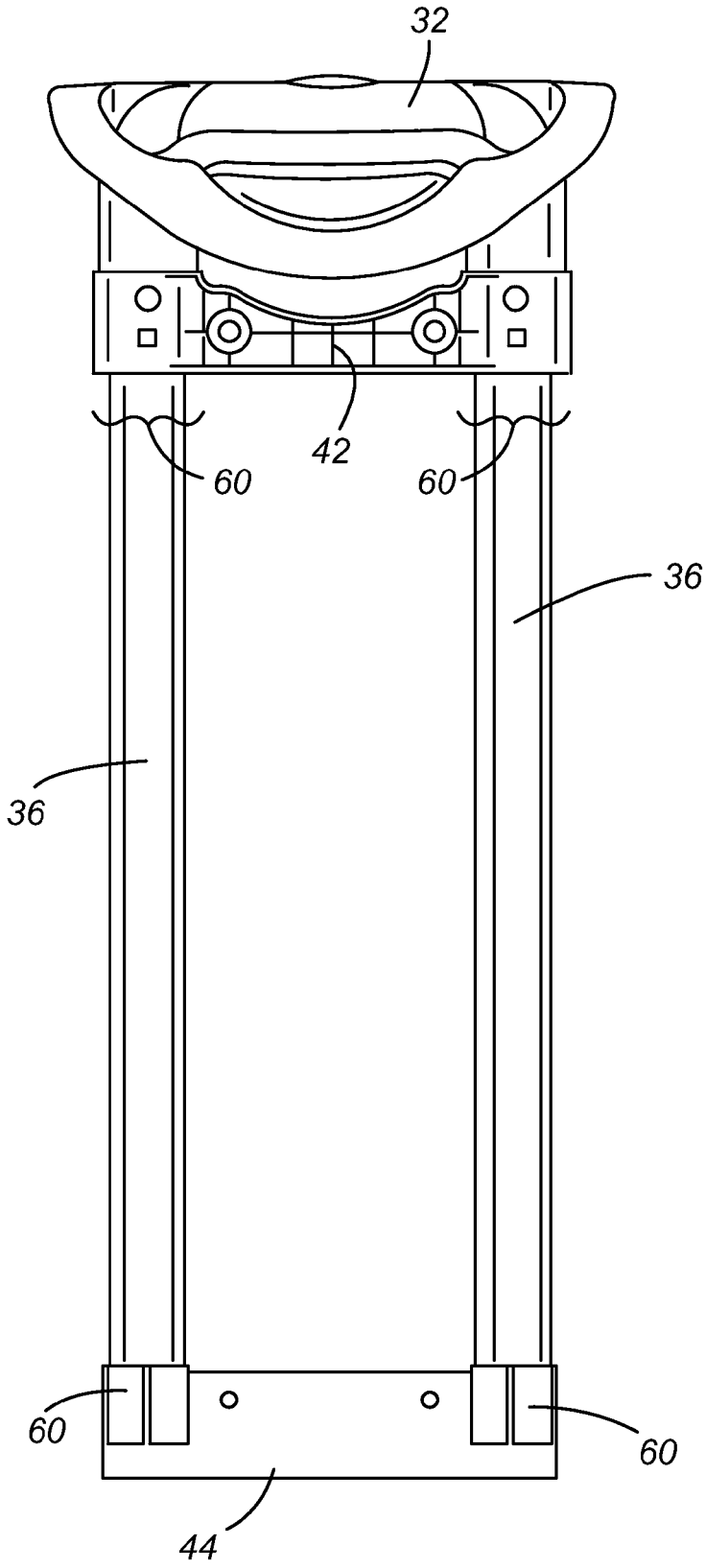
FIG. 5 is a front plan view of a handle assembly having an upper housing assembly and lower bracket mounted thereon according to another embodiment of the present invention.

The handle system 21 is interconnected to the support mechanism 2 by the upper housing 42 and the lower bracket assembly 44. FIG. 5 depicts handle assembly 32 interconnected to the upper housing 42 and the lower bracket assembly 44.

Figure 4:
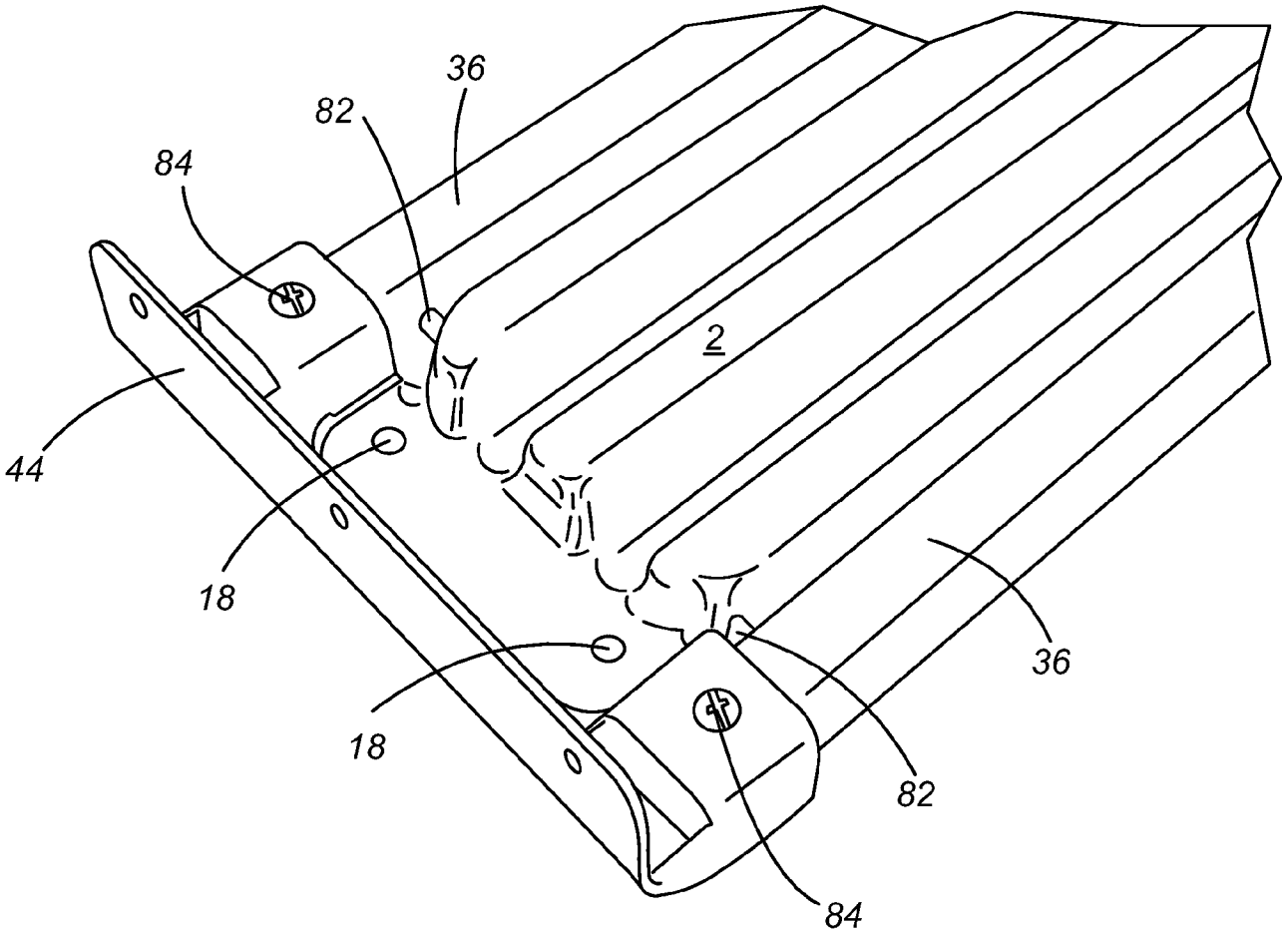
FIG. 4 is a partial elevation view of a lower bracket mounted to the lower end of the support mechanism of FIG. 1 according to one embodiment of the present invention.
Figure 6:
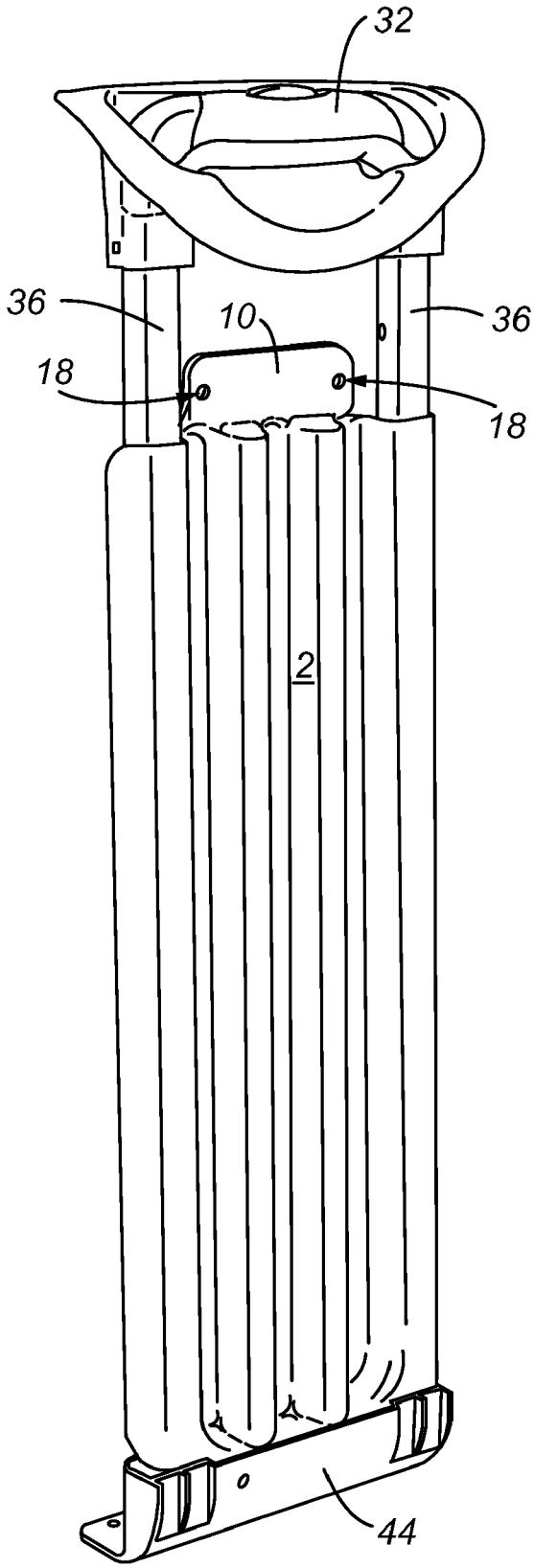
FIG. 6 is elevation view of a handle assembly having a lower bracket mounted thereon positioned within the support mechanism of FIG. 1 according to yet another embodiment of the present invention.

FIGS. 4 and 6 depict lower ends of the handle tubes 36 interconnected to the lower bracket assembly 44. The lower bracket assembly 44 is positioned over the lower handle tubes 36. The lower ends of the handle tubes 36 interconnected to the lower bracket assembly 44 by one or more lower assembly attachment means 84 (FIG. 4). Preferably, each lower end of the handle tubes further comprises a biased stop pin 82. The biased stop pin 82 restrains the retractable handle from being extended beyond a predetermined position. The lower assembly attachment means 84 comprises one or more of a bolt, a dowel, a rivet, a screw, a pressure fit or a combination thereof. The handle tubes 36 positioned in the support member grooved passage way is interconnected to the lower bracket assembly 44 (FIG. 6).

The upper housing assembly 42 has at least one passageway 60 for receiving at least one handle tube 36. Furthermore, the at least one passageway is aligned with at least one grooved passage 14. Preferably, the upper housing assembly 42 nests with the upper end 10 of the support mechanism 2. More preferably, the upper end 10 of the support mechanism 2 fits within an interior portion of the upper housing assembly 42.

A structural member for reinforcing the storage container 50 is formed by securing the handle system 32 to the support mechanism 2 by upper housing assembly 42 and the lower bracket assembly 44. The structural member is secured to the storage container 50, preferably about the upper housing assembly 42 about the handle grip 34. Preferably, a wheel assembly 40 is interconnected to the storage container 50.

In a preferred embodiment, the upper housing assembly 42 and the lower bracket assembly 44 interconnect the storage container 50, the handle tubes 36 and the support mechanism 2. Preferably, the lower bracket assembly 44 is interconnected to the storage container 50, the handle tubes 36 and the support mechanism 2 by one of a screw, a rivet, and a pin. Preferably, the upper housing assembly 42 interconnects the handle tubes 36 by a friction fit and one or both of the storage container 50 and the support mechanism 2 by one of a screw, a rivet and a pin.

To assist in the understanding of the present invention the following list of components and associated numbering found in the drawings is provided herein:

| Number | Component |
|---|---|
| 2 | luggage support mechanism |
| 4 | support mechanism side |
| 6 | support beam front surface |
| 8 | support mechanism back surface |
| 10 | support mechanism upper end |
| 12 | support mechanism lower end |
| 14 | grooved passage |
| 16 | reinforcing rib |
| 18 | support attachment mechanism |
| 20 | container back wall |
| 22 | container front wall |
| 24 | container side walls |
| 26 | container top wall |
| 28 | internal bottom wall |
| 30 | internal back wall surface |
| 32 | handle system |
| 34 | handle grip |
| 36 | handle tubes |
| 38 | lateral edge |
| 40 | wheel assembly |
| 42 | upper housing assembly |
| 44 | lower bracket assembly |
| 46 | inner leg |
| 48 | outer leg |
| 50 | storage container |
| 52 | support mechanism length |
| 54 | support mechanism width |
| 56 | container length |
| 58 | container width |
| 60 | receiving element |
| 62 | support mechanism thickness |
| 66 | container liner |
| 68 | rib width |
| 70 | rib radius of curvature |
| 72 | grooved-passage width |
| 74 | grooved-passage radius of curvature |
| 76 | grooved-passage depth |
| 78 | rib depth |
| 82 | stop pin |
| 84 | lower assembly attachment mechanism |

A number of variations and modifications of the invention can be used. It would be possible to provide for some features of the invention without providing others.

The present invention, in various embodiments, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, includes providing devices and processes in the absence of items not depicted and/or described herein or in various embodiments hereof, including in the absence of such items as may have been used in previous devices or processes, e.g. for improving performance, achieving ease and\or reducing cost of implementation.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A reinforcement mechanism adapted for positioning within a piece of luggage with a retractable handle, comprising:

a generally rectangularly shaped support member having an upper end, a lower end, opposing lateral edges extending therebetween, and a front surface and a back surface;

a pair of substantially parallel grooved passages positioned on said front surface and adapted to receive at least a portion of a retractable handle assembly;

a plurality of reinforcing ribs positioned between said pair of grooved passages, said plurality of reinforcing ribs aligned substantially parallel to said pair of grooved passages and extending substantially between said upper end and said lower end of said support member, said plurality of reinforcing ribs having a serpentine shaped cross-section; and an upper and a lower attachment plate interconnected to said support member for interconnecting said support member to a handle assembly.

2. The reinforcement mechanism of claim 1, wherein said pair of grooved passages generally have one of a "U" or "C" cross-sectional shape.

3. The reinforcement mechanism of claim 1, wherein the reinforcement mechanism is comprised of at least one of a metal, a metal alloy, a polymer, a composite, a polymeric blend, a polymeric laminate, a fiberglass material, a carbon fiber material, and a combination thereof.

4. The reinforcement mechanism of claim 1, wherein said lower attachment plate is interconnected to a lower bracket assembly.

5. The reinforcement mechanism of claim 1, wherein said upper and said lower attachment plate further comprise an aperture adapted to receive at least one of a screw, a bolt, a pin and a rivet.

6. The reinforcement mechanism of claim 1, further comprising an upper bracket assembly which slidingly engages an upper portion of the retractable handle assembly to provide additional structural rigidity to the retractable handle assembly.

7. The reinforcement mechanism of claim 6, wherein said upper attachment plate is interconnected to said upper bracket assembly.

8. A wheeled luggage system with a retractable handle, comprising:

a storage compartment having a back wall, a front wall, a pair of side walls, a top wall and a bottom wall;

a luggage support member interconnected to said back wall of said storage compartment, the luggage support member comprising:

a substantially rigid plate comprising an upper end, a lower end and two lateral edges extending therebetween;

a pair of substantially parallel grooved passages adapted to receive a portion of the retractable handle, wherein said grooved passages extend longitudinally between said upper end and said lower end of said substantially rigid plate;

at least two reinforcing ribs positioned between said grooved passages and aligned substantially parallel to said grooved passages, said at least two reinforcing ribs extending substantially from said upper end to said lower end of said substantially rigid plate, said at least two reinforcing ribs each having an arcuate cross-sectional shape, wherein the retractable handle comprises a handle grip and a pair of handle tubes, and wherein said handle tubes are positioned within said grooved passages and can be selectively extended;

a lower bracket assembly which is positioned over a lower portion of said handle tubes to provide structural support;

an upper housing assembly which includes a pair of passageways aligned with said grooved passages and which receives said handle tubes; and a wheel assembly operably interconnected to said bottom wall of said storage compartment.

9. The wheeled luggage system of claim 8, wherein said grooved passages generally have one of a "U" or "C" cross-sectional shape.

10. The wheeled luggage system of claim 8, wherein said luggage support member is comprised of at least one of a metal, a metal alloy, a polymer, a composite, a fiberglass material, a carbon fiber material, a polymeric blend, a polymeric laminate, and a combination thereof.

11. The wheeled luggage system of claim 8, wherein said luggage support member is positioned between said handle tubes and said back wall to provide impact protection to said handle tubes.

12. The wheeled luggage system of claim 8, further comprising at least one attachment mechanism positioned in said support member which is adapted to attach said support member to said back wall of said storage compartment.

13. The wheeled luggage system of claim 8, wherein said upper housing assembly is interconnected to said upper end of said substantially rigid plate, and said lower bracket assembly is interconnected to said lower end of said substantially rigid plate.

14. The wheeled luggage system of claim 13, wherein said upper end of said substantially rigid plate is substantially planar and fits within an interior portion of said upper housing assembly.

15. The wheeled luggage system of claim 13, wherein said lower end of said substantially rigid plate is substantially planar and fits within an interior portion of said lower bracket assembly.

16. The wheeled luggage system of claim 8, wherein said substantially rigid plate has a serpentine shaped cross-sectional shape.

17. A retractable handle assembly adapted for use within an interior space of a piece of wheeled luggage, comprising:

a handle interconnected to a pair of handle tubes;

a substantially rigid plate having an upper end, a lower end and lateral edges extending therebetween;

a pair of grooved passages in said substantially rigid plate, said grooved passages aligned substantially parallel with said lateral edges and adapted to receive said handle tubes;

a plurality of reinforcing ribs positioned between said grooved passages, said plurality of reinforcing ribs aligned substantially parallel to said grooved passages and extending longitudinally between said upper end and said lower end of said substantially rigid plate, said plurality of reinforcing ribs each having an arcuate cross-sectional shape;

an upper housing assembly which retains an upper portion of said handle tubes in a secure position, and which is interconnected to said upper end of said substantially rigid plate; and a lower bracket assembly which overlaps a lower portion of said handle tubes and is interconnected to said lower end of said substantially rigid plate.

18. The retractable handle assembly of claim 17, wherein said upper end of said substantially rigid plate is substantially planar and fits within an interior portion of said upper housing assembly.

19. The retractable handle assembly of claim 17, wherein said lower end of at least one handle tube includes a biased stop pin which restrains said handle from being extended beyond a predetermined position.

20. The retractable handle assembly of claim 17, wherein said upper housing assembly is slidingly engaged to said handle tubes to allow minor adjustments during assembly of the retractable handle assembly to the piece of luggage.

21. The retractable handle assembly of claim 17, wherein said lower end of said substantially rigid plate is substantially planar and fits within an interior portion of said lower bracket assembly.

* * * * *